US006823634B2

(12) United States Patent
Wright

(10) Patent No.: US 6,823,634 B2
(45) Date of Patent: Nov. 30, 2004

(54) HORIZONTAL SPACER TO FORM ANGLED GLASS BLOCK WALLS

(75) Inventor: Brian Wright, Snohomish, WA (US)

(73) Assignee: Seattle Glass Block, Woodinville, WA (US)

( * ) Notice: Subject to any disclaimer, the term of this patent is extended or adjusted under 35 U.S.C. 154(b) by 0 days.

(21) Appl. No.: 10/289,223

(22) Filed: Nov. 7, 2002

(65) Prior Publication Data

US 2004/0088935 A1 May 13, 2004

(51) Int. Cl.[7] ..... E04G 17/02

(52) U.S. Cl. ..... 52/306; 52/396.08; 52/396.09; 52/562

(58) Field of Search ..... 52/306, 307, 308, 52/396.08, 396.09, 562; 403/178, 267, 408.1

(56) References Cited

U.S. PATENT DOCUMENTS 2,239,537 A 4/1941 Owen
5,010,704 A * 4/1991 Thompson ..... 52/308
5,655,345 A * 8/1997 Thompson ..... 52/396.1
5,704,177 A 1/1998 Wirkus et al.
5,806,263 A * 9/1998 Coleman ..... 52/306
5,907,937 A * 6/1999 Loftus et al. ..... 52/308
5,988,942 A * 11/1999 Atkinson ..... 405/20
6,224,031 B1 * 5/2001 Boeshart ..... 249/214

OTHER PUBLICATIONS

Mortarless Blokup Components, Glass Masonry Inc., www-.glassmasonry.com/BlokUpComponents, Printed Jul. 29, 2002.4 pages.

* cited by examiner

*Primary Examiner*—Carl D. Friedman
*Assistant Examiner*—Basil Katcheves
(74) *Attorney, Agent, or Firm*—Hall, Myers, Vande Sande & Pequignot

(57) ABSTRACT

This application discloses a horizontal spacer for rectangular and non-rectangular glass blocks, which enables non-rectangular glass blocks to be connected to adjacent non-rectangular or rectangular glass blocks such that any configuration of wall may be formed using such blocks. The horizontal spacer has elongated tabs and receiving holes which extend from opposing sides. The elongated tabs engage the receiving holes of adjacent horizontal spacers.

31 Claims, 9 Drawing Sheets

HORIZONTAL SPACER TO FORM ANGLED GLASS BLOCK WALLS

FIELD

The present invention is directed toward the field of horizontal spacers for glass blocks. In particular, the present invention relates to horizontal spacers for positioning on rectangular and non-rectangular glass blocks, which enables non-rectangular glass blocks to be connected to adjacent non-rectangular or rectangular glass blocks such that any configuration of wall may be formed using such blocks.

BACKGROUND OF THE INVENTION

Glass blocks are widely used in modern architecture and in the construction industry for building things such as walls, partitions and shower walls. For rectangular glass blocks, the interface surface between vertical stacks of such blocks is rectangular. The interface surface for non-rectangular glass blocks have edges which form angles of 22½ degrees, 45 degrees, 90 degrees, and radius blocks having curved outer surfaces. Rectangular and non-rectangular glass blocks have a raised peripheral flange formed around the external faces of the block and an intermediate raised peripheral flange disposed proximate the midpoint of the internal periphery of the glass block.

When assembling a glass block wall with mortar a high degree of skill is required, as the weight of the blocks on the mortar make it difficult to obtain evenly spaced horizontal or vertical course arrangements between each row of blocks. Also, the blocks tend to be non-porous and as a result do not form a strong bond with the mortar. In order to solve these problems, many glass block assemblies exist which use generally rigid spacing, reinforcement and tying devices for the blocks. However, many of these assemblies have a large number of parts, and/or require a skilled laborer to assemble the glass block wall.

As a consequence, there is a need for a horizontal spacer for non-rectangular glass blocks that not only enables the same size joints to be easily obtained, but also allows the joints to be adjusted. Further, there is a need for a horizontal spacer for non-rectangular glass blocks that has a minimal number of parts such that the glass block wall may be constructed quickly and easily by an unskilled laborer, thereby reducing the cost. Accordingly, it is an object of the invention to provide a horizontal spacer for positioning on rectangular or non-rectangular glass blocks, which may connect to an adjacent horizontal spacer from the present invention or with a rectangular glass block horizontal spacer.

SUMMARY OF THE INVENTION

The present invention provides a horizontal spacer for positioning on rectangular and non-rectangular glass blocks, which enables a connection to a spacer on an adjacent non-rectangular or rectangular glass block. The horizontal spacer comprises a generally planar main portion that is positioned between the peripheral edges of the top and/or bottom surfaces of the non-rectangular glass block and tabs, which extend in the plane of and extending from opposing sides of the main portions. Receiving holes are also located on opposing sides of the main portion. The tabs connect to other non-rectangular horizontal spacers by inserting the tabs into the receiving holes of the adjacent horizontal spacer. The tabs can also connect to a rectangular horizontal spacer by inserting the tabs directly into the spacer. The tabs extend perpendicularly from an edge of the main portion enabling a square connection to be made to an adjacent non-rectangular or rectangular horizontal spacer, such that any configuration of angled or curved glass wall can be installed with a reduced amount of time and effort. Further, the tabs allow for the spacing between the joints to be varied as well as for minor lateral adjustments.

The horizontal spacer preferably consists of two identical pieces. The main portion of each piece has holes and pegs, which connect the identical pieces together. Preferably, the tabs on one side of the main portion are diagonally opposite from the tabs on the other side, as are the receiving holes. Therefore, as the tabs are offset, two tabs and two receiving holes are located on opposing sides. Advantageously, parts are minimized as one piece of the horizontal spacer may be used for the first and last row, where a spacer of lesser thickness is required.

BRIEF DESCRIPTION OF THE DRAWINGS

Further features and advantages of the invention will be apparent from the following detailed description, given by way of example, of a preferred embodiment taken in conjunction with the accompanying drawings, wherein.

DETAILED DESCRIPTION OF THE INVENTION

Figure 1:
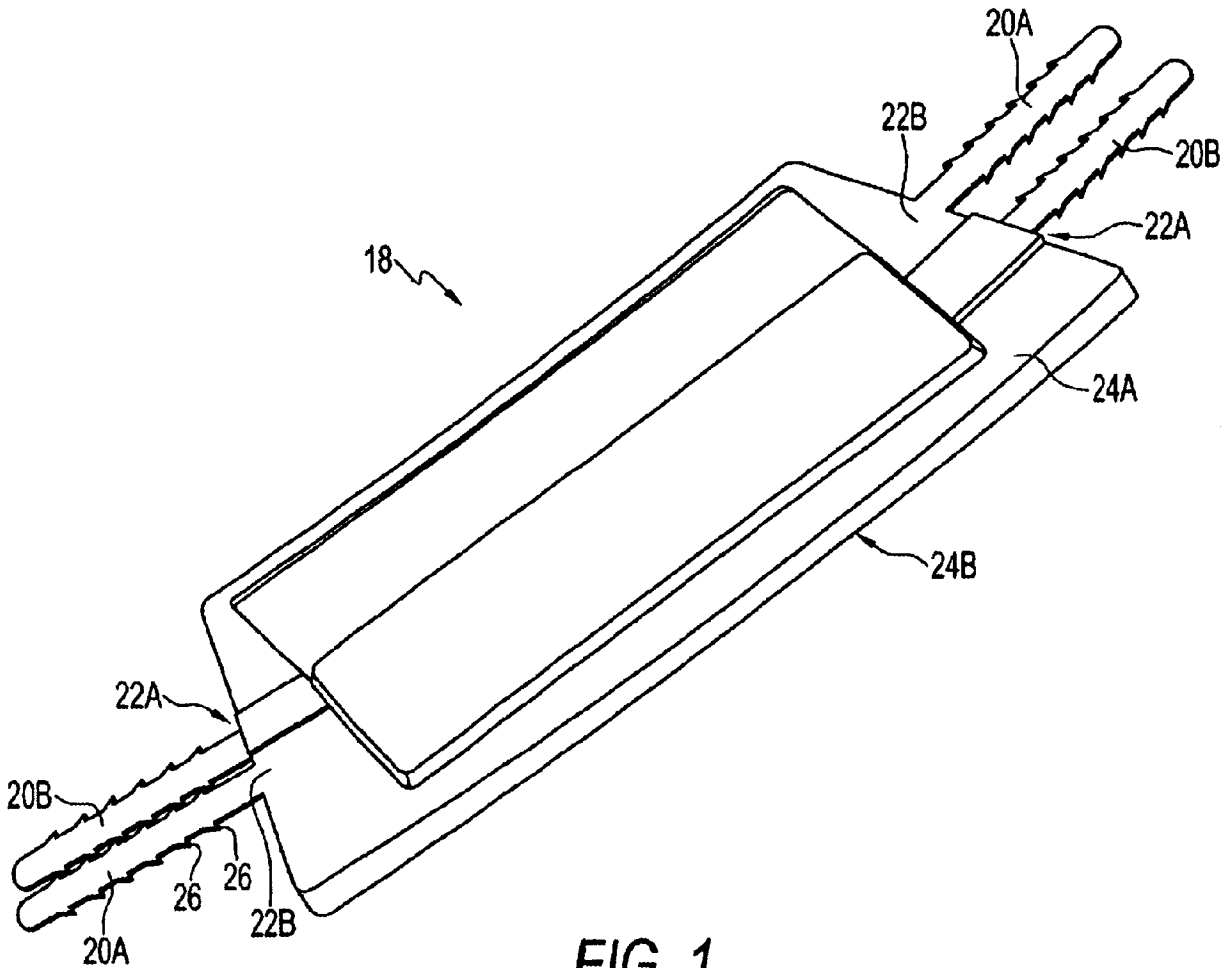
FIG. 1 is a perspective view of the horizontal spacer for use with radius glass blocks.

Referring to FIG. 1, a perspective view of the horizontal spacer 18 for a radius glass block, such as the ARQUE® block by Pittsburgh-Corning Company, is shown. Two identical main pieces 24A and 24B connect together to form the horizontal spacer 18. Each main piece 24A and 24B includes elongated tabs 20A and 20B and receiving holes 22A and 22B. Preferably, tabs 20A and receiving holes 22B are adjacent on one side of each of the main pieces 24A and 24B and tabs 20B and receiving holes 22A are adjacent on the opposing side of each of the main pieces 24A and 24B. The tabs 20A and 20B extend perpendicularly from the main pieces 24A and 24B such that a square connection can be made to adjacent horizontal spacers. The tabs 20A and 20B include barbs 26 that aid in fitting the tabs into corresponding receiving holes of other horizontal spacers of the system. The tabs 20A and 20B are insertably adjustable into the receiving holes of adjacent rectangular or non-rectangular horizontal spacers and allow the spacing between the joints of adjacent glass blocks to be varied.

Figure 2:
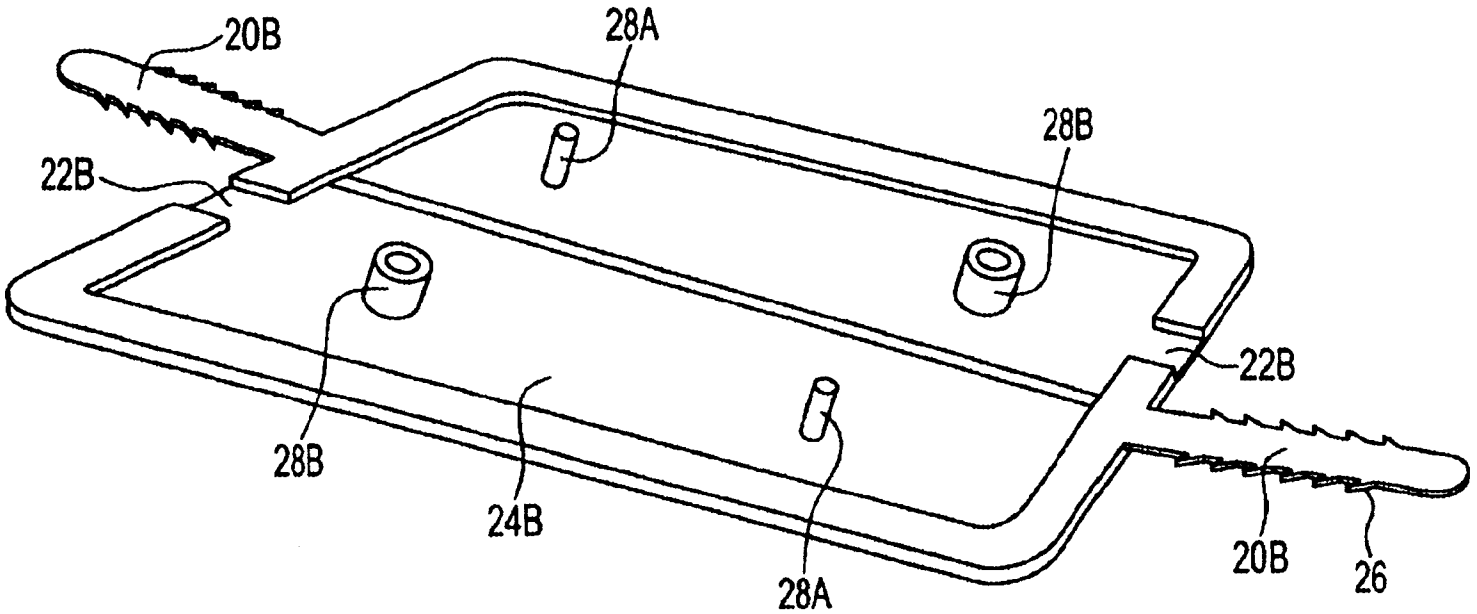
FIG. 2 is a perspective view of one half of the horizontal spacer for use with radius glass blocks.

Referring to FIG. 2, a perspective view of main piece 24B of the horizontal spacer 18 having a radius shape is shown. Main pieces 24A and 24B each include pegs 28A and holes 28B, such that the pegs 28A of piece 24A connect to holes 28B on piece 24B to connect the pieces together to form the horizontal spacer 18 as shown in FIG. 1.

Main pieces 24A and 24B may be used as the first or last row of spacers when constructing a glass block wall, where a spacer of lesser thickness is required.

Figure 3:
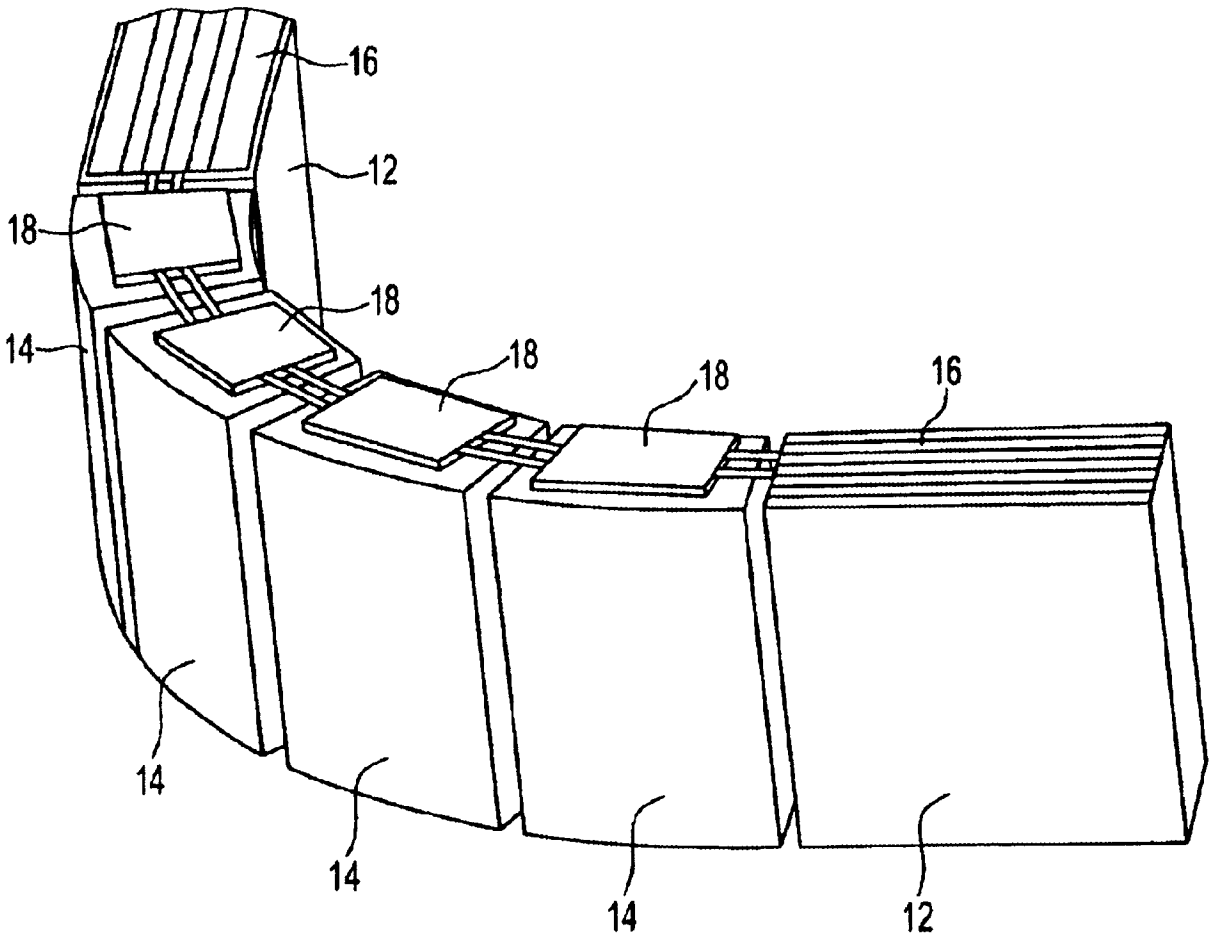
FIG. 3 is a perspective view of a section of glass block wall constructed in accordance with the teachings of this invention using the horizontal spacer for radius glass blocks.

Referring to FIG. 3 a perspective view of a glass block wall 10 is shown using radius horizontal spacers 18 with the radius blocks 14 and rectangular horizontal spacers 16 for straight blocks 12. As shown in the drawing the main portion of the horizontal spacer 18 fits within the peripheral edges of the top of the radius glass block 14. The type of glass blocks 12 used have a generally rectangular configuration with a raised peripheral flange formed around the external faces of the block and an intermediate raised peripheral flange disposed proximate the midpoint of the internal periphery of the glass block. Rectangular glass blocks are available in various sizes from various commercial sources such as Pittsburgh-Corning Company.

Figure 4:
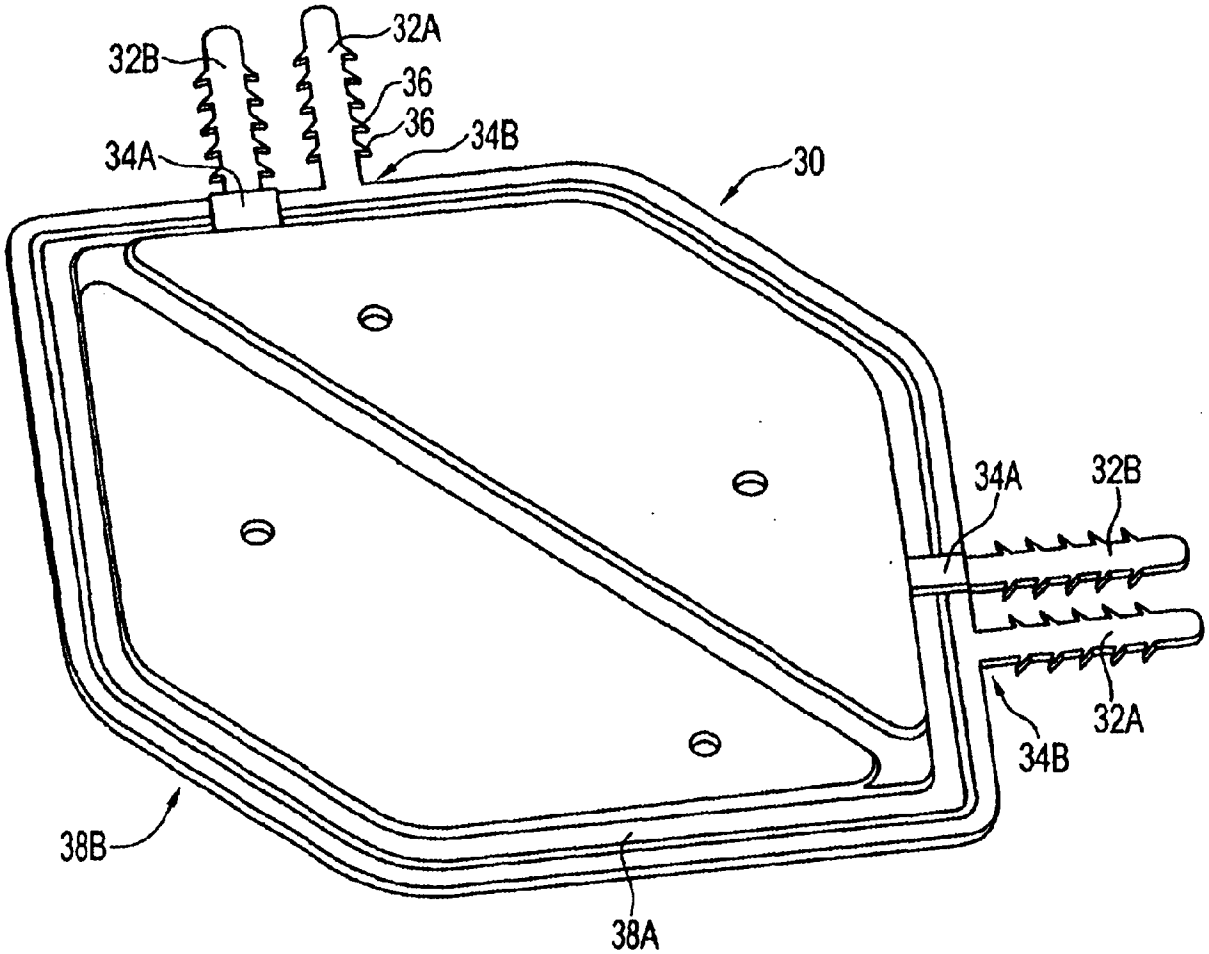
FIG. 4 is a top view of the horizontal spacer for use with 90-degree glass blocks.

Referring to FIG. 4, a perspective view of the horizontal spacer 30 for a 90 degree glass block, such as the HEDRON® corner block by Pittsburgh-Corning Company is shown. Two identical main pieces 38A and 38B connect together to form the horizontal spacer. Each main piece 38A and 38B includes elongated tabs 32A and 32B and receiving holes 34A and 34B. Preferably, tabs 32A and receiving holes 34B are adjacent on one side of each of the main pieces 38A and 38B and tabs 32B and receiving holes 34A are adjacent and on the opposing side of each of main pieces 38A and 38B. The tabs 32A and 32B extend perpendicularly from the main pieces 38A and 38B such that a square connection can be made to adjacent horizontal spacers. The tabs 32A and 32B include barbs 36 that aid in fitting the tabs into corresponding receiving holes of other horizontal spacers of the system. The tabs 32A and 32B are insertably adjustable into the receiving holes of adjacent rectangular or non-rectangular horizontal spacers and allow the spacing between the joints of adjacent glass blocks to be varied.

Figure 5:
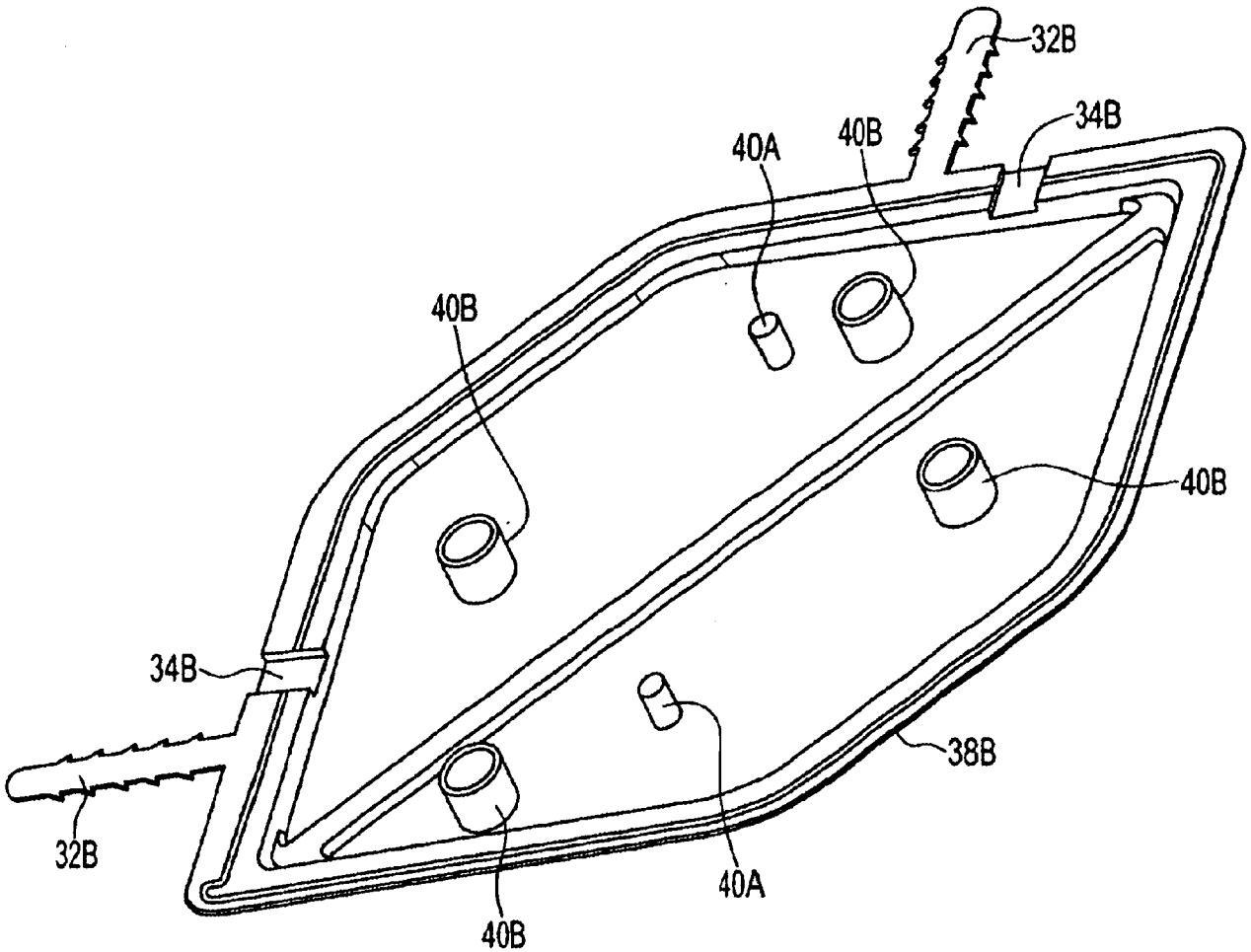
FIG. 5 is a perspective view of one half of the horizontal spacer for use with 90-degree glass blocks.

Referring to FIG. 5, a perspective view of main piece 38B of the horizontal spacer 30 having a 90 degree shape is shown. Main pieces 38A and 38B each include pegs 40A and holes 40B, such that the pegs 40A of piece 38A connect to holes 40B on piece 38B to connect the pieces together to form the horizontal spacer 30 as shown in FIG. 4.

Main pieces 38A and 38B may be used as the first or last row of spacers when constructing a glass block wall, where a spacer of lesser thickness is required.

Figure 6:
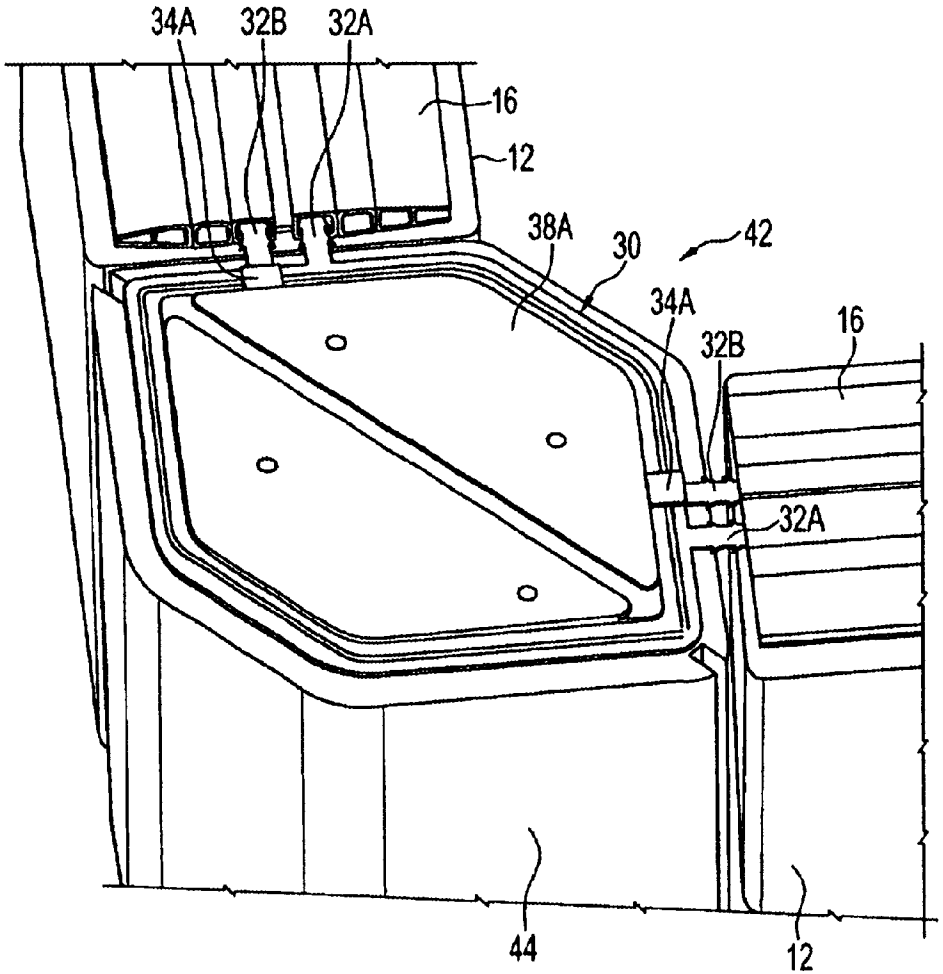
FIG. 6 is a perspective view of the horizontal spacer for use with 90-degree glass blocks in use with adjacent rectangular glass blocks.

Referring to FIG. 6 a perspective view of a glass block wall 42 is shown using 90 degree horizontal spacer 30 with the 90 degree block 44 and rectangular horizontal spacers 16 for rectangular glass blocks 12. As shown in the drawing the main portion of the horizontal spacer 30 fits within the peripheral edges of the top of the 90 degree glass block 44.

Figure 7:
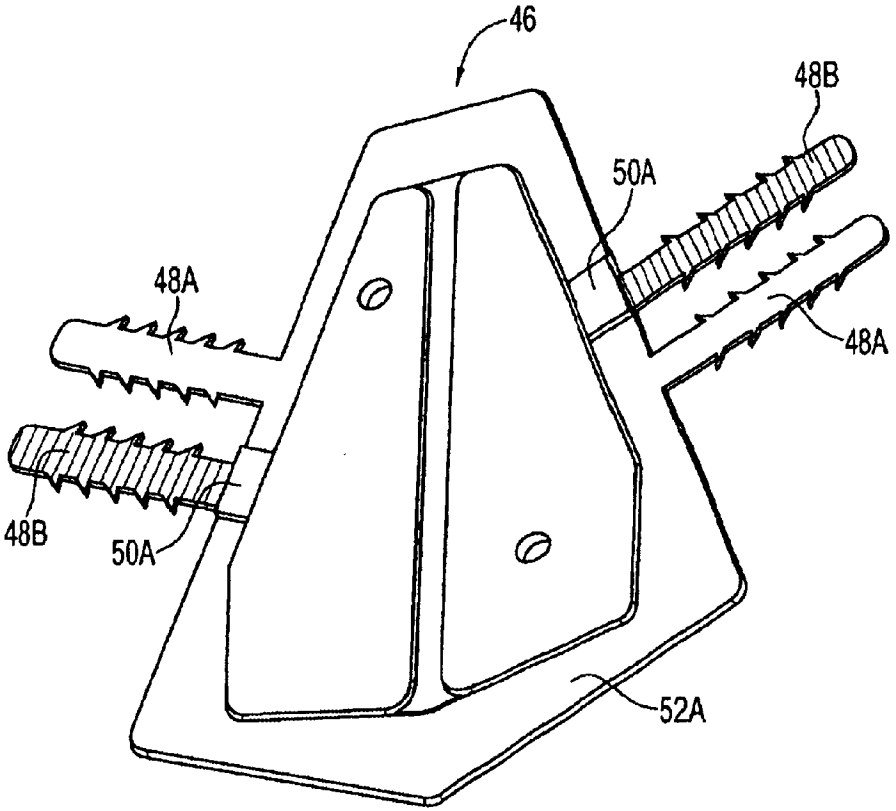
FIG. 7 is a perspective view of the horizontal spacer for use with 45-degree glass blocks.
Figure 8:
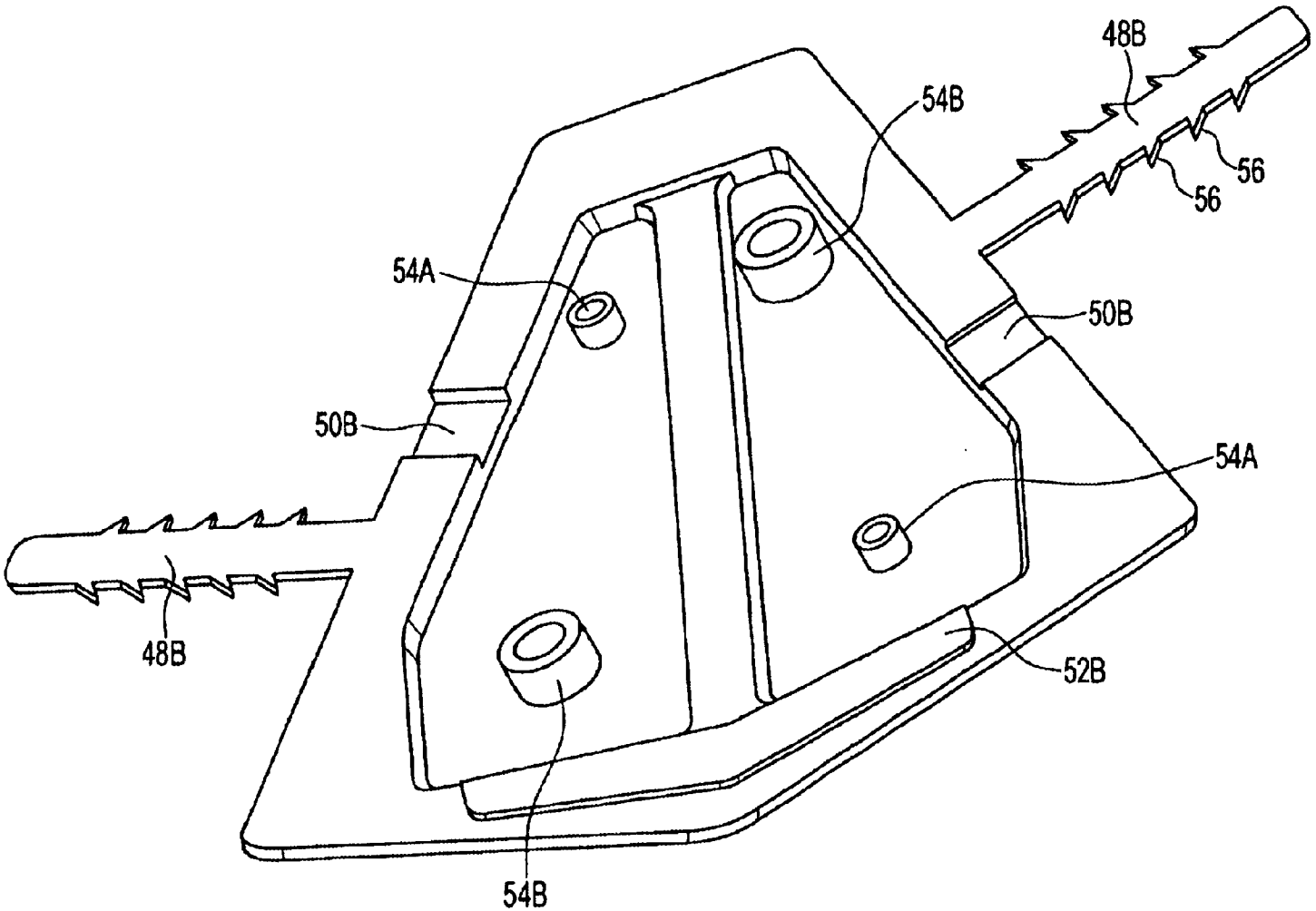
FIG. 8 is a perspective view of one half of the horizontal spacer for use with 45 degree glass blocks.

Referring to FIG. 7, a perspective view of the horizontal spacer 46 for a 45 degree glass block, such as the TRIDRON® 45 degree block units by Pittsburgh-Corning Company is shown. Referring to FIG. 8 a perspective view of main piece 52B of the horizontal spacer 46 for a 45 degree block. Referring to FIGS. 7 and 8, two identical main pieces 52A and 52B connect together to form the horizontal spacer 46. Each main piece 52A and 52B includes elongated tabs 48A and 48B and receiving holes 50A and 50B. Preferably, tabs 48A and receiving holes 50B are adjacent on one side of each of the main pieces 52A and 52B and tabs 48B and receiving holes 50A are adjacent on the opposing side of each of main pieces 52A and 52B. The tabs 48A and 48B extend perpendicularly from the main pieces 52A and 52B such that a square connection can be made to adjacent horizontal spacers. The tabs 48A and 48B include barbs 56 that aid in fitting the tabs into corresponding receiving holes of other horizontal spacers of the system. The tabs 48A and 48B are insertably adjustable into the receiving holes of adjacent rectangular or non-rectangular horizontal spacers and allow the spacing between the joints of adjacent glass blocks to be varied.

Main pieces 52A and 52B each include pegs 54A and holes 54B, such that the pegs 54A of piece 52A connect to holes 54B on piece 52B to connect the pieces together to form the horizontal spacer 46 as shown in FIG. 7.

Main pieces 52A and 52B may be used as the first or last row of spacers when constructing a glass block wall, where a spacer of lesser thickness is required.

Figure 9:
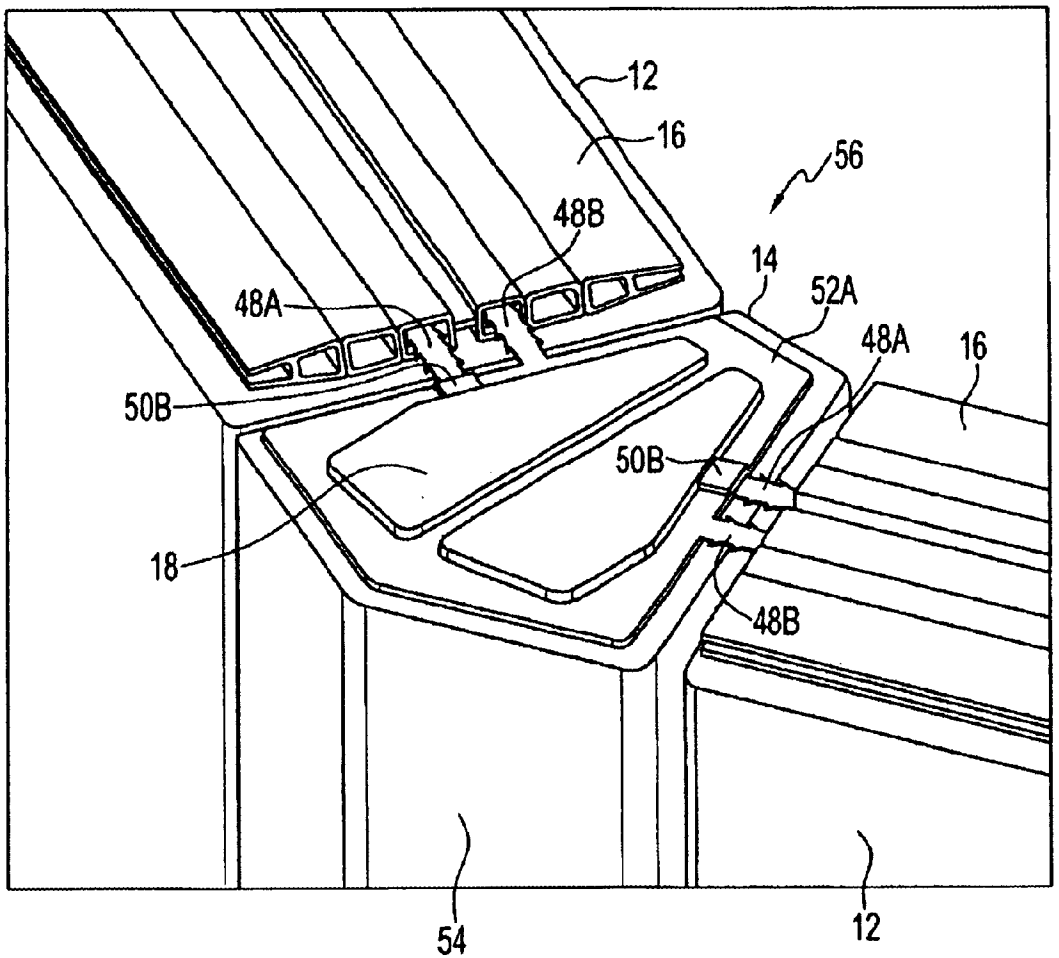
FIG. 9 is a perspective view of the horizontal spacer for use with 45-degree glass blocks in use with adjacent rectangular glass blocks.

Referring to FIG. 9 a perspective view of a glass block wall 56 is shown using a 45 degree horizontal spacer 46 with a 45 degree block 54 and rectangular horizontal spacers 16 for rectangular glass blocks 12. As shown in the drawing the main portion of the horizontal spacer 18 fits within the peripheral edges of the top of the radius glass block 14.

The three examples of horizontal spacers shown are radius, 45 degree, and 90 degree; however, any shape of horizontal spacer can be formed to accommodate any rectangular or non-rectangular glass block. Further, although two tabs and two receiving holes are described, more or less than two tabs or receiving holes may be used.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to the description. It is therefore contemplated that the appended claims will cover any such modifications or embodiments as fall within the true scope of the invention.

What is claimed is:

1. A horizontal spacer for positioning on a non-rectangular glass block for use in spacing adjacent glass blocks, comprising:

(a) a generally planar main portion shaped to match one of a top and a bottom surface of said non-rectangular glass block and to engage said surface of said non-rectangular glass block;

(b) a first elongated tab extending in the plane of, and extending from a first edge of said main portion, operative to engage a first adjacent horizontal spacer mounted on a first adjacent glass block; and (c) a second elongated tab extending in the plane of and extending from a second edge of said main portion non-adjacent to said first edge operative to engage a second adjacent horizontal spacer mounted on a second adjacent glass block.

2. The horizontal spacer of claim 1, wherein said first and second elongated tabs include barbs extending out from opposed side edges thereof.

3. The horizontal spacer of claim 1, wherein said main portion has a radius shape.

4. The horizontal spacer of claim 1, wherein said main portion has a 90 degree shape.

5. The horizontal spacer of claim 1, wherein said main portion has a 45 degree shape.

6. The horizontal spacer of claim 1, wherein said main portion is comprised of two identical pieces that are connected.

7. The horizontal spacer of claim 6, wherein each of said two identical pieces further includes a plurality of male and female parts operative to guide said two identical pieces into opposed alignment.

8. The horizontal spacer of claim 6, wherein one of said two identical pieces is operative to space a bottom row of glass blocks.

9. The horizontal spacer of claim 1, wherein said first and second elongated tabs are perpendicular to said first and second edges, respectively.

10. The horizontal spacer of claim 1, wherein said first and second elongated tabs are insertably adjustable into receiving holes of said first and second adjacent horizontal spacers, respectively.

11. A horizontal spacer for positioning on a non-rectangular glass block for use in spacing adjacent glass blocks, comprising:

(a) a generally planar main portion shaped to match one of a top and a bottom surface of said non-rectangular glass block and to engage said surface of said non-rectangular glass block;

(b) a first elongated tab extending in the plane of, and extending from a first edge of said main portion, operative to engage a first adjacent horizontal spacer mounted on a first adjacent glass block;

(c) a first receiving hole located at said first edge of said main portion proximate said first elongated tab and operative to engage an elongated tab on said first adjacent horizontal spacer;

(d) a second elongated tab extending in the plane of, and extending from a second edge of said main portion non-adjacent to said first edge operative to engage a second adjacent horizontal spacer mounted on a second adjacent glass block; and (e) a second receiving hole located at said second edge proximate said second elongated tab and operative to engage an elongated tab on said second adjacent horizontal spacer.

12. The horizontal spacer of claim 11 wherein said first and second elongated tabs include barbs.

13. The horizontal spacer of claim 11, wherein said main portion has a radius shape.

14. The horizontal spacer of claim 11, wherein said main portion has a 90 degree shape.

15. The horizontal spacer of claim 11, wherein said main portion has a 45 degree shape.

16. The horizontal spacer of claim 11, wherein said main portion is comprised of two identical pieces that are connected.

17. The horizontal spacer of claim 16, wherein each of said two identical pieces further includes a plurality of male and female parts operative to guide said two identical pieces into opposed alignment.

18. The horizontal spacer of claim 16, wherein one of said two identical pieces is operative to space a bottom row of glass blocks.

19. The horizontal spacer of claim 11, wherein said first and second elongated tabs are perpendicular to said first and second edges, respectively.

20. The horizontal spacer of claim 11, wherein said first and second elongated tabs are insertably adjustable into receiving holes of said first and second adjacent horizontal spacers, respectively.

21. A horizontal spacer for positioning on a non-rectangular glass block for use in spacing adjacent glass blocks, comprising:

(a) a generally planar main portion shaped to match one of a top and a bottom surface of said non-rectangular glass block and to engage said surface of said non-rectangular glass block;

(b) a first plurality of elongated tabs extending in the plane of, and extending from a first edge of said main portion, operative to engage a first adjacent horizontal spacer mounted on a first adjacent glass block;

(c) a first plurality of receiving holes of a number at least equal to the number of elongated tabs on said first adjacent horizontal spacer, said first plurality of receiving holes located at said first edge of said stain portion proximate said first plurality of elongated tabs and operative to engage all elongated tabs on said first adjacent horizontal spacer;

(d) a second plurality of elongated tabs extending in the plane of, and extending from a second edge of said main portion non-adjacent to said first edge operative to engage a second adjacent horizontal spacer mounted on a second adjacent glass block; and (e) a second plurality of receiving holes of a number at least equal to the number of elongated tabs on said second adjacent horizontal spacer, said second plurality of receiving holes located at said second edge of said main portion proximate said second plurality of elongated tabs and operative to engage all elongated tabs on said second adjacent horizontal spacer.

22. The horizontal spacer of claim 21, wherein said first and second plurality of elongated tabs includes barbs.

23. The horizontal spacer of claim 21, wherein said first and second adjacent horizontal spacers are selected from the group consisting of a horizontal spacer, and a rectangular horizontal spacer.

24. The horizontal spacer of claim 21, wherein said non-rectangular glass block has a radius shape.

25. The horizontal spacer of claim 21, wherein said non-rectangular glass block has a 90 degree shape.

26. The horizontal spacer of claim 21, wherein said non-rectangular glass block has a 45 degree shape.

27. The horizontal spacer of claim 21, wherein said main portion is comprised of two identical pieces.

28. The horizontal spacer of claim 27, wherein one of said two identical pieces is operative to space a bottom row of glass blocks.

29. The horizontal spacer of claim 27, wherein each of said two identical pieces further includes a plurality of male and female parts operative to guide said two identical pieces into opposed alignment.

30. The horizontal spacer of claim 21, wherein said first and second plurality of elongated tabs are perpendicular to said first and second edges, respectively.

31. The horizontal spacer of claim 21, wherein said first and second plurality of elongated tabs are insertably adjustable into receiving holes of said first and second adjacent horizontal spacers, respectively.

* * * * *